US006823561B2

(12) United States Patent
Park et al.

(10) Patent No.: US 6,823,561 B2
(45) Date of Patent: Nov. 30, 2004

(54) MAGNETIC TYPE FLOOR HINGE

(75) Inventors: Kyihwan Park, Kwangju (KR); Kapjin Lee, Kwangju (KR); Jinpyo Hong, Wonju-shi (KR)

(73) Assignee: Kwangju Institute of Science and Technology, Kwangju (KR)

( * ) Notice: Subject to any disclaimer, the term of this patent is extended or adjusted under 35 U.S.C. 154(b) by 0 days.

(21) Appl. No.: 10/279,041

(22) Filed: Oct. 24, 2002

(65) Prior Publication Data

US 2003/0135953 A1 Jul. 24, 2003

(30) Foreign Application Priority Data

Jan. 22, 2002 (KR) ..... 10-2002-3495

(51) Int. Cl.[7] ..... E05D 11/10; E05F 3/10

(52) U.S. Cl. ..... 16/320; 16/378; 16/53; 16/354; 16/50

(58) Field of Search ..... 16/320, 378, 49, 16/72, 76, 54, 53, 60, 50, 68, 354

(56) References Cited

U.S. PATENT DOCUMENTS 3,665,958 A * 5/1972 Dunkelis ..... 137/522
3,701,180 A * 10/1972 Jentsch et al. ..... 16/55
3,724,023 A * 4/1973 Tillmann ..... 16/53
3,742,553 A * 7/1973 Sittmann ..... 16/55
3,838,477 A * 10/1974 Evans et al. ..... 16/55
4,434,524 A * 3/1984 Gilchrist ..... 16/250
4,506,407 A * 3/1985 Downey ..... 16/48.5
5,337,448 A * 8/1994 Brown ..... 16/53
6,205,619 B1 * 3/2001 Jang ..... 16/352
6,314,612 B1 * 11/2001 Rennecke et al. ..... 16/54

FOREIGN PATENT DOCUMENTS

DE 2533161 A * 1/1977
GB 2052621 A * 1/1981

* cited by examiner

*Primary Examiner*—Chuck Y. Mah
(74) *Attorney, Agent, or Firm*—Finnegan, Henderson, Farabow, Garrett & Dunner, L.L.P.

(57) ABSTRACT

A magnetic type floor hinge installed on a door, comprising an installing bracket, a moving plate, a compressing spring, a longitudinal hole in the moving plate, a main shaft cam in contact with the longitudinal hole. The main shaft cam is rotatably connected to a hinge shaft of the door and rotates with the hinge shaft. The magnetic type floor hinge further comprises at least one roller attached to the moving plate, a disk rotatably attached to the installing bracket, a yoke attached to the installing bracket and arranged around a magnetic operating part, and a gear-box comprising a plurality of gears that are connected between a rotating shaft of the main shaft cam and a rotating shaft of the disk. During operation of this magnetic type floor hinge, the rotating movement of the door hinge is converted to a rotating movement of the disk.

9 Claims, 4 Drawing Sheets

MAGNETIC TYPE FLOOR HINGE

BACKGROUND OF THE INVENTION

1. Field of the Invention

The present invention relates to a magnetic type floor hinge that reduces the speed of opening and shutting of a door while absorbing undesirable mechanical impact, and more particularly, to a magnetic type floor hinge which is constructed in a non-contacted type by employing a magnetic damper.

2. Description of the Prior Art

A floor hinge is an auxiliary apparatus for a door, which is installed at the bottom surface of all sorts of doors (gates) and provides damping force so as to enable the doors to open and shut at a low speed.

In general, as shown in FIG. 1, a conventional floor hinge widely used is a hydraulic floor hinge and mainly comprises a main body 1, a piston 2, a compressing spring 3, a moving plate 4, a rod 5, a pin 6 and a cam 7. A pair of the pins 6 and the rod 5 are coupled to each other between the two moving plates 4. One end of the rod 5 is fixed to the piston 2 so that the moving plate 4, the pin 6, the rod 5 and the piston 2 move integrally. One end of the compressing spring 3 is fixed to the piston 2 and the other end is fixed to the interior of the main body 1. The interior of the main body 1 is divided into a hinge operating part 8 and a hydraulic operating part 9. The hydraulic operating part 9 is filled with oil and has an airtight structure. A pair of orifices 10 and 11 is formed at one end of the hydraulic operating part 9, which are opened or shut conversely with each other according to rectilinear movement of the piston 2.

In the conventional hydraulic floor hinge constructed as described above, when the door is opened, the cam 7 fixed to the rotating shaft of the door rotates and the pin 6 contacted with the cam 7 moves linearly. According to the linear movement of the pin 6, the piston 2 fixed to the rod 5 linearly moves and gets compressed. At the same time, the pair of orifices 10 and 11 are opened and clogged, respectively, by the piston 2 so that the oil flows from the high pressure portion of the compressed hydraulic operating part 9 to the low pressure portion where negative pressure is generated through the orifices 10 and 11 to generate damping force. The damping force generated as described above reduces the speed of movement of the piston 2 which goes straight on so that the damping force makes the door open or shut slowly at a low speed when the door is opened or shut. When the door is opened, the compressing spring 3 is compressed due to the forward movement of the piston 2, and then the piston 2 is regressed by the restitution force of the compressing spring 3. So although no force is applied to the door, the door becomes shut.

However, in the conventional hydraulic floor hinge constructed as described above, when the cam 7 pushes the pin 6, a torque is generated at the pin 6 around the rotating shaft of the cam 7 so that the piston 2 is contacted with the inner surface of the main body 1. Because of this, an abrasion is generated between the piston 2 and an inner wall of the main body 1. When oil leakage occurs between the piston 2 and the inner wall of the main body 1 due to the abrasion, the damping force of the hydraulic operating part is lowered. Thus, shutting speed of the door becomes faster than originally configured and the door is opened more easily.

Also, regarding the force for shutting the door, frictional force between the piston 2 and the inner wall of the main body 1 as well as frictional force between the cam 7 and the pin 6 should be considered in designing the conventional compressing spring 3 so that a spring constant of the compressing spring 3 is increased and an expected life span of the compressing spring 3 is reduced due to increase in the spring constant thereof.

Further, in the conventional hydraulic floor hinge, since the coefficient of viscosity of oil violently varies according to the temperature, there is a problem that the opening and shutting speed of doors is varied according to the change of temperature. Meanwhile, although a floor hinge which is provided with a control switch for controlling the opening and shutting speed of the door is disclosed, there are problems such as a rise in cost due to the addition of a device and inconvenience in use which a user has to control the control switch every time.

SUMMARY OF THE INVENTION

Therefore, an object of the present invention is to solve the above problems of the conventional floor hinge.

Another object of the present invention is to provide a magnetic type floor hinge which minimizes the friction force by applying the magnetic damper to the magnetic floor hinge and generating damping force in a way of non-contacted type and which can reduce the opening and shutting speed of the door constantly regardless of variation of temperature.

To achieve objects as described above, the present invention discloses a magnetic type floor hinge installed on the bottom surface of a door for maintaining the opening and shutting of the door at a low speed. The magnetic type floor hinge according to the present invention comprises an installing bracket divided into a magnetic operating part and a hinge operating part having one end on which a guide rail 33 is installed; a moving plate installed to move linearly on the guide rail 33; a compressing spring installed between the moving plate and the installing bracket in the moving direction of the moving plate; a main shaft cam rotatably installed on the upper portion of the moving plate, the main shaft cam being combined with a hinge shaft of the door and rotated along with the hinge shaft; a roller installed on one end of the moving plate, the roller being contacted with a cam-shaped surface of the main shaft cam; a disk rotatably installed at one end of the magnetic operating part of the installing bracket; a yoke installed on the magnetic operating part of the installing bracket, the yoke having permanent magnets attached thereto so as to generate repulsive force toward the upper and lower surfaces of the disk; and a gear-box in which a plurality of gears are received installed between the rotating shaft of the main shaft cam and the rotating shaft of the disk so as to convert the rotating movement of the main shaft cam at low speed to the rotating movement of the disk at high speed.

BRIEF DESCRIPTION OF THE DRAWINGS

The aforementioned aspects and other features of the present invention will be explained in the following description, taken in conjunction with the accompanying drawings, wherein.

DETAILED DESCRIPTION OF THE INVENTION

Figure 1:
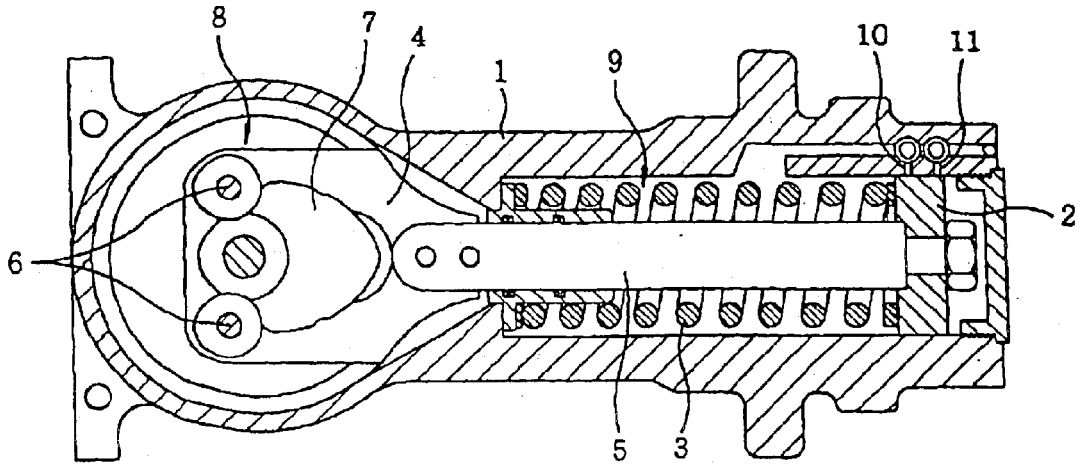
FIG. 1 is a sectional view showing a conventional hydraulic floor hinge.

The present invention is described in detail by way of a preferred embodiment with reference to accompanying drawings, in which like reference numerals are used to identify the same or similar parts.

Figure 2:
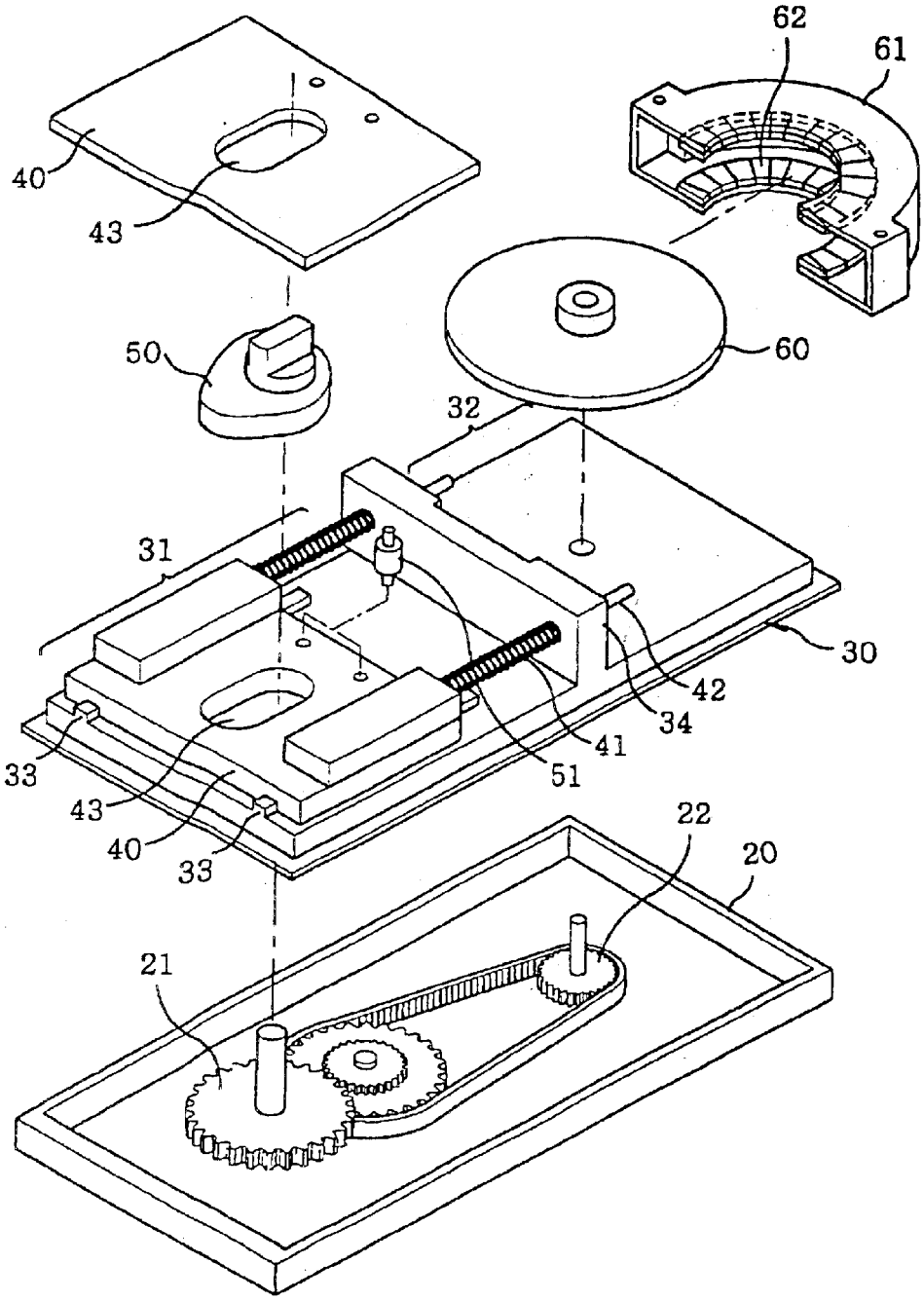
FIG. 2 is a disassembled perspective view showing a magnetic type floor hinge according to the present invention.
Figure 3:
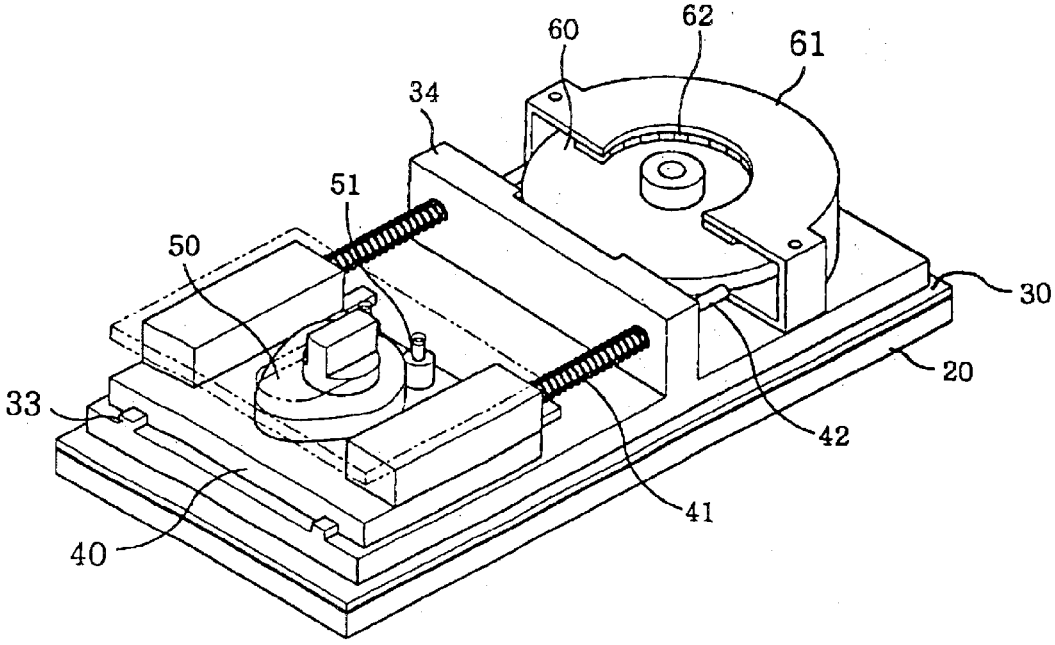
FIG. 3 is a perspective view showing a magnetic type floor hinge according to the present invention.
Figure 4:
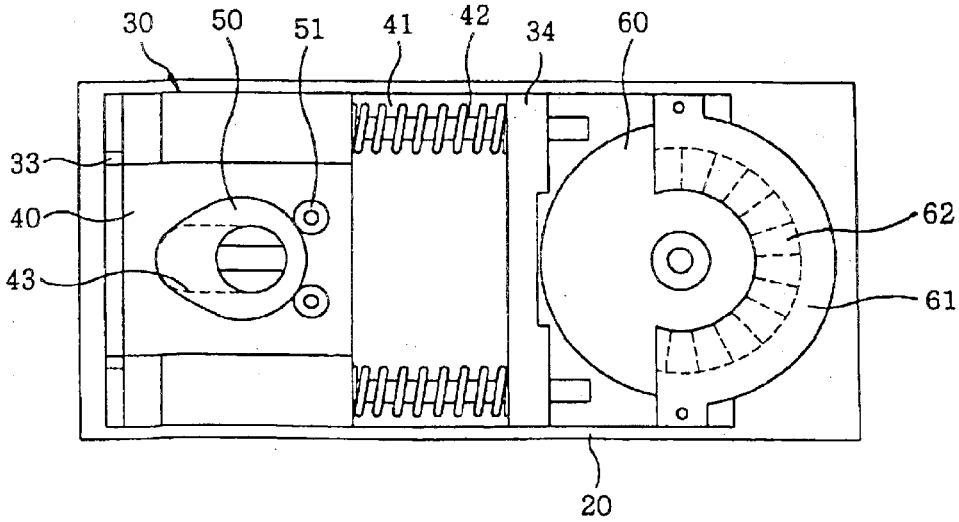
FIG. 4 is a cross sectional view showing a magnetic type floor hinge according to the present invention.
Figure 5:
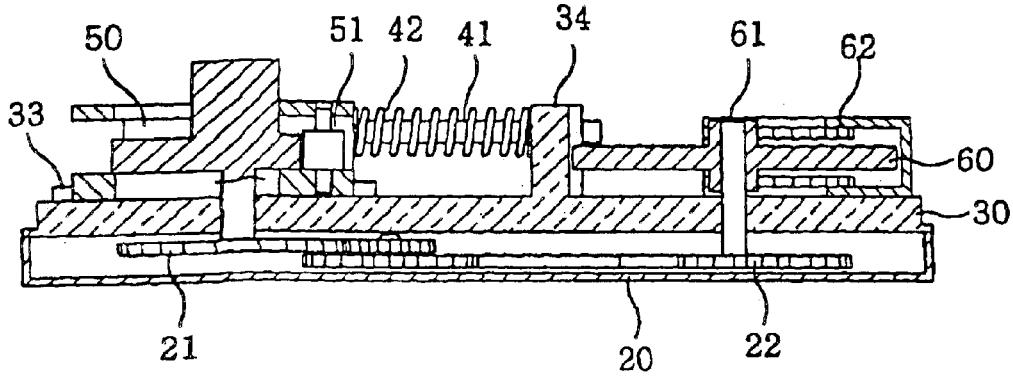
FIG. 5 is a side sectional view showing a magnetic type floor hinge according to the present invention.
Figure 6:
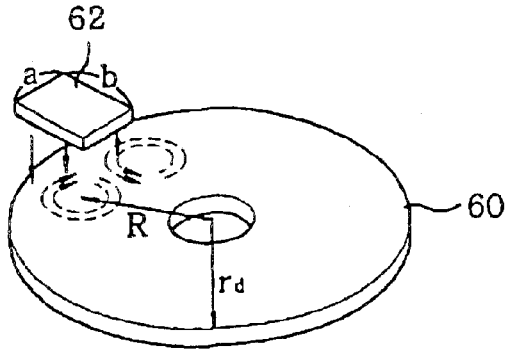
FIG. 6 is a view for illustrating repulsive force generated from a permanent magnet and a disk according to the present invention.

FIG. 2 is a disassembled perspective view showing a magnetic type floor hinge according to the present invention, FIG. 3 is a perspective view showing a magnetic type floor hinge according to the present invention, FIG. 4 is a cross sectional view showing a magnetic type floor hinge according to the present invention and FIG. 5 is a side sectional view showing a magnetic type floor hinge according to the present invention.

As shown in the drawings, the magnetic type floor hinge according to the present invention is installed the bottom surface of a door and maintains the opening and shutting speed of the door constantly. The upper surface of a gearbox 20 is used as an installing bracket 30.

The installing bracket 30 according to the present invention is divided into a hinge operating part 31 and a magnetic operating part 32 at both sides of a section wall 34 formed on a center thereof, and a guide rail 33 is installed integrally at one end portion of the hinge operating part 31. A moving plate 40 is mounted slidably on the guide rail 33 to move linearly. A compressing spring 41 is installed between the moving plate 40 and the section wall of the installing bracket 30. The compressing spring 41 is compressed by linear movement of the moving plate 40. A compressing spring guide rod 42 is provided in the interior of the compressing spring 41 for guiding the operation of the compressing spring 41, one end of the compressing spring guide rod 42 is fixed to the moving plate 40 and the other end side is passed through the section wall 34 to slide in response to the movement of the moving plate 40.

The moving plate 40 according to the present invention comprises a pair of moving plates 40 and a main shaft cam 50 is rotatably installed between the moving plates 40. The main shaft cam 50 is combined with the rotating shaft of the door and can rotate along with the rotating shaft.

A longitudinal hole 43 is formed on the moving plate 40 in the direction of sliding movement of the moving plate 40 and the rotating shaft of the main shaft cam 50 is combined in the longitudinal hole 43 so that the main cam shaft can rotate along with the moving plate.

The main shaft cam 50 has an outer circumference surface in the form of a geometrical cam, this outer circumference surface of the cam shape is always contacted with a roller 51 installed at one end of the moving plate 40.

That is, the moving plate 40 is moved linearly according to the geometrical shape of the main shaft cam 50 contacted with the roller 51. For example, in the case that the moving plate 40 is rotated toward the major axis portion of the cam and then contacted with the roller 51, the moving plate 40 is slid slowly to the section wall and at this time, the compressing spring 41 is compressed. Also, once the roller 51 contacted with the outer circumference surface of the cam passes the major axis portion and the contacted surface thereof is rotates toward the minor axis portion, the moving plate 40 is pushed in the opposite direction of the section wall by restitution force of the compressed compressing spring 41 so the outer circumference surface of the main shaft cam 50 and the roller 51 always remain contacted.

In the present invention, the roller 51 has a bearing structure to always form rolling friction with the outer circumference surface of the main shaft cam 50 which is contacted with the roller so that loss of energy caused by friction is minimized, and the main shaft cam 50 and a pair of the rollers 51 are used.

After a user opens the door, although the user leaves the door as it is, the moving plate 40 as described above substantially enables the door to return to the original shut state by the compressing spring 41.

In the present invention, reduction of the opening and shutting speed of the door is substantially achieved by the magnetic operating part 32 as described below.

As described above, a disk 60 in the form of a circular plate is rotatably installed at one end of the magnetic operating part 32 of the installing bracket 30, and a yoke 61 faces the upper and lower surfaces of about a half of the disk 60 is installed. And, a plurality of permanent magnets 62 are arranged at regular intervals at one end of the yoke 61 facing the upper and lower surfaces of the disk 60 and the shape and the size of the permanent magnets 62 can be modified in variety to gain the stated repulsive force by those skilled in art.

It is desirable that the disk 60 according to the present invention is made of pure bronze that has excellent conductivity. The temperature coefficient of resistance (TCR) of pure copper is 4,000 ppm and theoretically, although the conductivity increases or decreases by 4% every time a temperature rises or falls 10° C., the variation of the viscosity coefficient of the oil according to the variation of temperature is very low in value, so there is practically little influence on the repulsive force.

The permanent magnets 62 facing the upper or lower surfaces of the disk 60 are attached in a manner that N pole and S pole are alternate, the permanent magnets 62 between which the disk 60 is located have a different polarity from each other, that is, the permanent magnets 62 faced to each other are arranged to maintain N pole and S pole or S pole and N pole. As described above, the direction of the line of magnetic force generated from a pair of permanent magnets 62 facing each other with different polarity and the direction of the line of magnetic force generated from an adjacent pair of the permanent magnets 62 are opposite from each other.

Meanwhile, according to rotation of the disk 60, repulsive force is generated between the permanent magnets 62 and the disk 60 due to interaction (Lorentz force) between an eddy current induced in the disk 60 and a magnetic field generated from the magnet. By such repulsive force, the opening and shutting speed of the door is substantially reduced and controlled.

Thus, in order to increase the repulsive force generated between the permanent magnets 62 and the disk 60, it is desirable that the rotating speed of the disk 60 is faster than that of the door. In the present invention, rotating movement of the door at low speed is converted to rotating movement of the disk 60 at high speed via the gear box 20.

In the illustrated drawing, the gear box 20 comprises a low gear 21 installed on the rotating shaft of the door, a high gear 22 installed on the rotating shaft of the disk, an acceleration gear connecting the low and high gears at a constant gearing ratio and a chain. Those skilled in the art can change the inner structure of the gearbox to obtain a certain gearing ratio.

The repulsive force is proportioned to the rotating speed θ1 of the door, a reduction ratio n of the gearbox 20 and the magnetic damping coefficient c defined as a function of a variety of design variables.

When an user takes his hand off the door in opened state, a restitution torque is transmitted to the main shaft cam 50 by the restitution force T(θ) of the already compressed spring 41, and rotating speed θ of the door is reduced by the permanent magnets 62, the disk 60 and the gear-box 20.

A dynamical related equation showing the above relationship expressed in mathematical is as follows.

$$I\theta^{\circ}+n^{2}c\theta'+T(\theta)=0 \qquad \text{[Equation]}$$

wherein I is rotational moment of inertia at the axis of the door which includes an equivalent moment of inertia of the disk, θ' is angular velocity of the door, θ° is angular acceleration of the door, and n is gearing ratio of the gearbox.

Since characteristics of the rotational movement of the door is determined by the above Equation, design for gearing ratio, the shape of the spring 41 and a cam member, and a magnetic damping coefficient determines the characteristics of the article.

Operation of the magnetic type floor hinge according to the present invention constructed as above is as follows.

The main shaft cam 50 according to the present invention is coupled to the rotating shaft of the door so that the cam 50 is rotated and transmits a rotational torque. Due to a geometrical shape of the main shaft cam 50, rotational movement of the main shaft cam 50 makes the moving plate 40 move linearly and makes the low gear 21 of the gear-box 20 rotate simultaneously. At this time, the roller 51 according to the present invention is contacted with the outer circumference surface of the main shaft cam 50 and rolled so that, compared with sliding movement between the pin 6 and the cam 7 in a conventional hydraulic type floor hinge, generated frictional force is reduced.

Movement of the moving plate 40 according to the present invention makes the compressing spring 41 compress and when external force is not applied to the door, the compressed spring 41 generates restitution force which makes the door return to the initial closed state. At this time, the compressed spring guide rod 42 guides the compressing spring 41 so as to perform compressing and restitution movement smoothly.

Meanwhile, as mentioned previously, the low gear 21 in the gear-box 20 is rotated at low speed by the main shaft cam 50 and makes the high gear 22 rotate at a high speed with the gearing ratio converted by a plurality of gears, which are already designed previously.

Therefore, the high gear 22 makes the disk installed at the magnetic operating part 32 rotate at higher speed than the rotating speed of the door.

Once the disk 60 according to the present invention is rotated at high speed between the yokes 61 on which the permanent magnets 62 are arranged, an eddy current is generated at the disk 60 so that repulsive force which prevents the disk 60 from rotating as described above is generated by an interaction between the permanent magnets 62 and the eddy current. Since magnitude of the repulsive force is proportioned to the rotating speed of the disk 60, the gearing ratio of the gears in the gearbox 20 can be predetermined and designed in order to obtain appropriate repulsive force.

The repulsive force as described above makes the rotating speed of the door maintain constantly when the door is opened or shut.

Since power of the user for opening the door is not always constant, if excessive force is applied to the door for opening, rotation of the disk 60 speeds up, and the repulsive force is increased as much as the increase of the rotating speed of the disk 60 so that the opening speed of the door is maintained constantly.

In opened state, although the user takes his hand off the door, the door is rotated in the direction to which the restitution force of the compressing spring 41 is acted that is, the door is shut automatically. At this time, if the door is shut by only the restitution force of the compressing spring 41, the shutting speed of the door will be accelerated by the compressing spring 41. In the present invention, however, rotation of the disk 60 is inhibited by the repulsive force generated between the disk 60 and the yoke 61 so that the shutting speed of the door due to the restitution force of the compressing spring 41 can be maintained constantly when the door is shut.

Although this invention has been described in its preferred form with a certain degree of particularity, it is appreciated by those skilled in the art that the present disclosure of the preferred form has been made only by way of example and that numerous changes in the details of the construction, combination, and arrangement of parts may be resorted to without departing from the spirit and scope of the invention.

As described above, according to the present invention, the floor hinge to which a magnetic type damper is applied is generates a damping force in a non-contacted type so that frictional force can be minimized, and the opening and shutting speed of the door can be maintained constantly in spite of change of temperature.

What is claimed is:

1. A magnetic type floor hinge installed on a door, comprising:

an installing bracket divided into a magnetic operating part and a hinge operating part, wherein said hinge operating part comprises a guide rail;

a moving plate slidably attached to the hinge operating part for linear movement on the guide rail;

a compressing spring installed between the moving plate and the installing bracket, wherein the compressing spring is compressed in a same direction of linear movement as the moving plate;

a longitudinal hole in the moving plate;

a main shaft cam in contact with the longitudinal hole in the moving plate, wherein the main shaft cam is rotatably connected to a hinge shaft of the door and rotates with the hinge shaft;

at least one roller attached to the moving plate, the in contact with a cam-shaped surface of the main shaft cam;

a disk rotatably attached to the magnetic operating part of the installing bracket;

a yoke attached to the installing bracket and arranged around the disk, the yoke having permanent magnets attached thereto so as to generate repulsive force toward an upper and lower surfaces of the disk; and a gear-box comprising a plurality of gears, which are connected between a rotating shaft of the main shaft cam and a rotating shaft of the disk, wherein a rotating movement of the main shaft cam is converted to a rotating movement of the disk.

2. The magnetic type floor hinge according to claim 1, wherein the at least one roller comprises a bearing structure so that the at least one roller rotates when the main shaft cam rotates.

3. The magnetic type floor hinge according to claim 2, further comprising at least two rollers attached to the moving plate.

4. The magnetic type floor hinge according to claim 1, wherein the yoke has a structure which encompasses the upper and lower surfaces of about a half of the disk, a plurality of permanent magnets are arranged at regular intervals at one end of the yoke so as to face the upper and lower surfaces of the disk.

5. The magnetic type floor hinge according to claim 1, wherein the disk is made of pure copper.

6. The magnetic type floor hinge according to claim 1, wherein the permanent magnet face each other with the disk therebetween, and are attached in a manner such that the polarities alternate.

7. The magnetic type floor hinge according to claim 1, wherein the gear box comprises a low gear installed on the rotating shaft of the door, a high gear installed on the rotating shaft of the disk, an acceleration gear connecting the low and high gears.

8. The magnetic type floor hinge according to claim 1, wherein the disk is made of bronze.

9. The magnetic type floor hinge according to claim 7, wherein the gear box further comprises a chain for connecting the high gear and acceleration gear.

* * * * *

UNITED STATES PATENT AND TRADEMARK OFFICE

CERTIFICATE OF CORRECTION

PATENT NO. : 6,823,561 B2
DATED : November 30, 2004
INVENTOR(S) : Kyihwan Park, Kapjin Lee and Jinpyo Hong It is certified that error appears in the above-identified patent and that said Letters Patent is hereby corrected as shown below:

Column 6,
Line 50, “the in” should read -- the roller in --

Column 7,
Line 13, “magnet” should read -- magnets --

Column 8,
Line 6, “disk, an” should read -- disk, and an --

Signed and Sealed this

Seventeenth Day of May, 2005

JON W. DUDAS
*Director of the United States Patent and Trademark Office*